US005964102A

United States Patent [19]

Tsai

[11] Patent Number: 5,964,102

[45] Date of Patent: Oct. 12, 1999

[54] COOL MUG

[76] Inventor: Yao-Ming Tsai, No. 86, Chin Nan Road, Ta She Hsiang, Kaohsiung Hsien, Taiwan

[21] Appl. No.: 08/988,036

[22] Filed: Dec. 10, 1997

[51] Int. Cl.[6] ..... F25D 3/08

[52] U.S. Cl. ..... 62/457.3; 62/530; 252/73

[58] Field of Search ..... 62/457.1, 457.2, 62/457.3, 457.4, 530, 529, 371; 252/71, 73

[56] References Cited

U.S. PATENT DOCUMENTS

| | | | |
|---|---|---|---|
| 4,273,667 | 6/1981 | Kent et al. | 252/70 |
| 4,369,299 | 1/1983 | Honda et al. | 526/329.7 |
| 4,402,195 | 9/1983 | Campbell | 62/457.3 |
| 4,570,454 | 2/1986 | Campbell | 62/457.3 |
| 5,271,244 | 12/1993 | Staggs | 62/457.3 |
| 5,718,835 | 2/1998 | Momose et al. | 252/73 |

*Primary Examiner*—William Doerrler
*Attorney, Agent, or Firm*—Rosenberg, Klein & Bilker

[57] ABSTRACT

A cool mug is provided with a closed chamber defined between an outer vessel and an inner vessel. The bottom is closed with a bottom cap to form the closed chamber. The bottom cap has a hole for filling the closed chamber with a thermal storage substance for low temperatures and then the hole is sealed to prevent the thermal storage substance from leaking out. Acrylate resin copolymer is mixed with water and used as the low-temperature thermal storage substance. Further, a substance may also be added in the acrylate resin copolymer mixture for imparting freeze resistant properties thereto, and acting as an antiseptic.

1 Claim, 3 Drawing Sheets

COOL MUG

BACKGROUND OF THE INVENTION

This invention relates to a cool mug, particularly one having a close chamber filled with an absorptive polymer as a thermal storage substance for low temperatures so as to shorten time needed in freezing, and elongate frozen time as well.

A prior art cool mug shown in FIG. 1 is provided with two rims 10, 11, forming a closed chamber 12 in which water is held.

The cool mug 1 of the prior art is provided to keep drinks held therein cold and initially kept in a freezer so that the water filled in the closed chamber 12 becomes ice. However, the prior art cool mug 1 has been found to have the following disadvantages.

1. The low-temperature thermal storage substance, water needs four hours or so to be frozen in a common refrigerator.

2. The low-temperature thermal storage substance, water after frozen, quickly absorbs heat, defrosting in one hour or so.

SUMMARY OF THE INVENTION

A purpose of the invention is to offer a cool mug improved in the disadvantages mentioned above, having acrylate resin copolymer added with water held in the closed chamber formed between an outer rim and an inner rim of a cool mug so as to quicken freezing time and elongate its melting time as well.

Another purpose of the invention is to offer a cool mug having acrylate resin copolymer added with water further additionally mixed with a freeze-resist substance and an antiseptic so as to improve the freezing function and the serving time of the low-temperature thermal storage substance.

BRIEF DESCRIPTION OF DRAWINGS

The file of this Patent contains at least one drawing executed in color. Copies of this Patent with color drawing (s) will be provided by the Patent and Trademark Office upon request and payment of the necessary fee.

This invention will be better understood by referring to the accompanying drawings, wherein.

DETAILED DESCRIPTION OF THE PREFERRED EMBODIMENT

Figure 1:
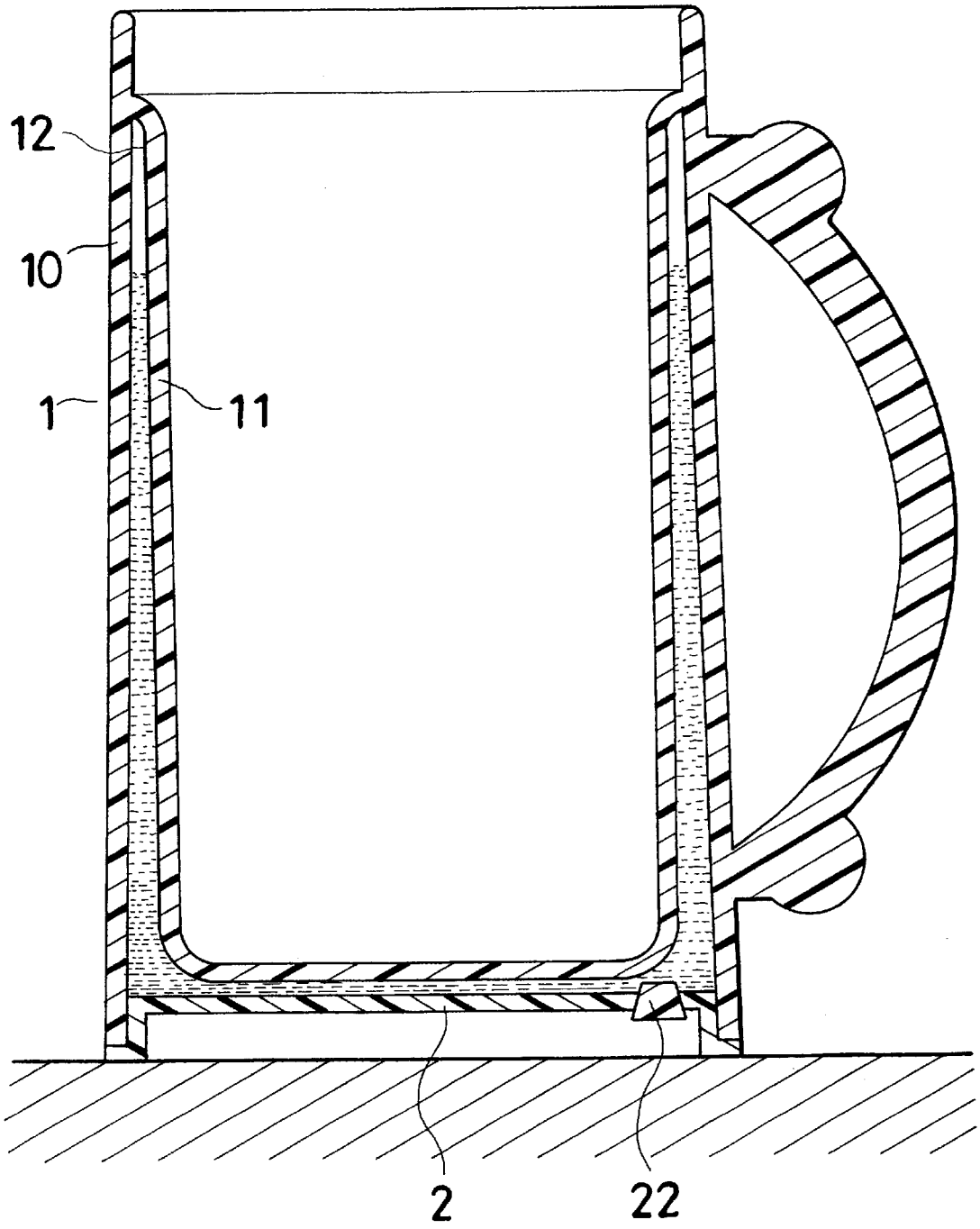
FIG. 1 (PRIOR ART)
FIG. 1 is a side cross-sectional view of a conventional cool mug with a closed chamber filled with water.
Figure 2:
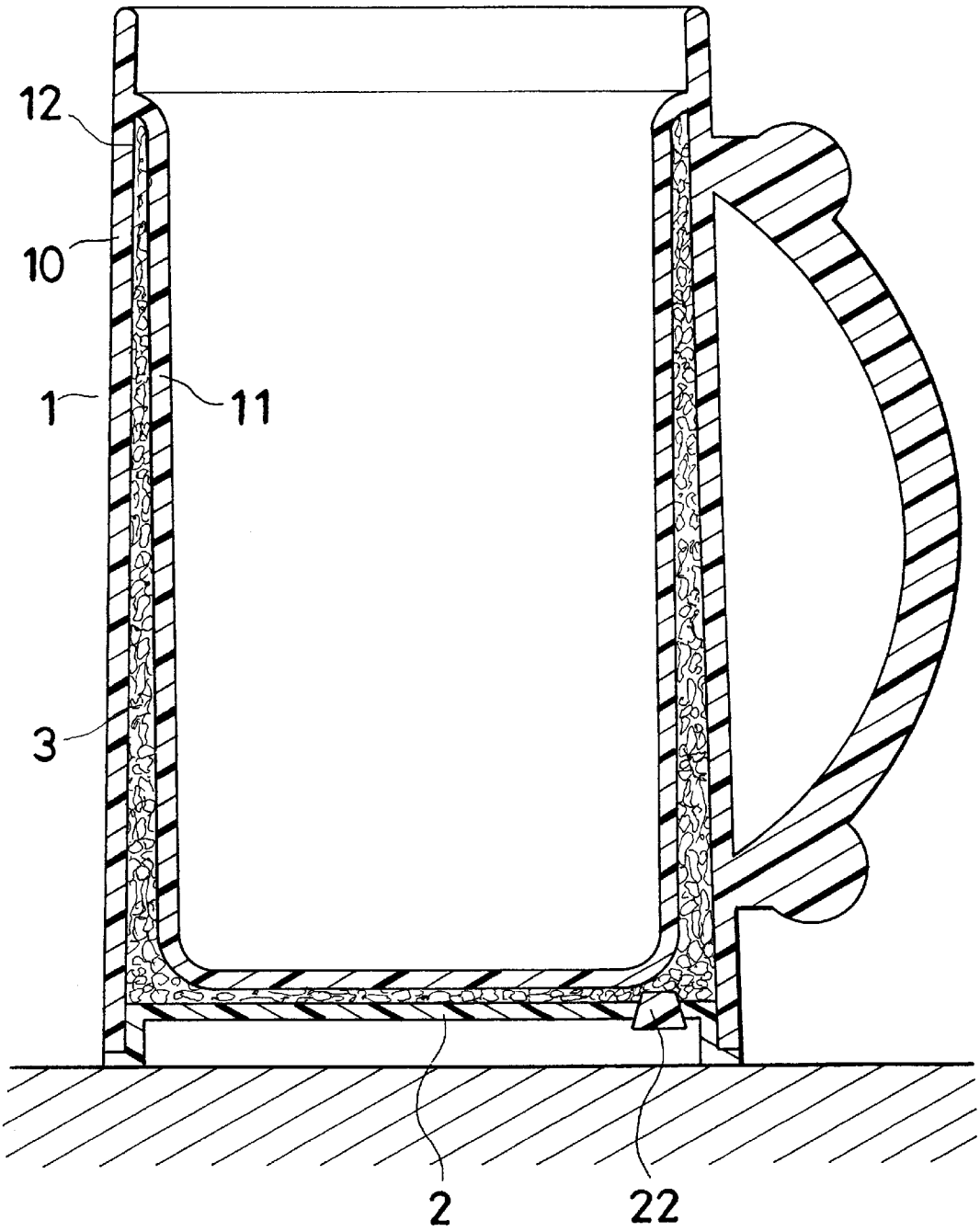
FIG. 2 is a cross-sectional view of a cool mug of the present invention; and, FIG. 3 is a photograph of the cool mug and the conventional cool mug.

A preferred embodiment of a cool mug in the present invention, as shown in FIG. 2, includes an outer rim 10, an inner rim 11, and a closed chamber 12 formed between the outer rim 10 and the inner rim 11. In the closed chamber is filled with water absorptive polymer composed of acrylate resin copolymer in wet block shape as a low-temperature thermal storage substance.

The water absorptive polymer of acrylate resin copolymer is originally small grains of semi-transparent state, expanding to dimensions of several times into a semi-solid state, if added with proper volume of water. And its chemical formula is

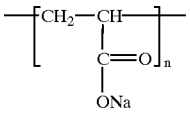

In the conventional cool mug, water used as a low-temperature keeping substance is not fully filled in the closed chamber 12, as it will expand a little after frozen. But in the cool mug of the present invention, the low-temperature thermal storage substance, acrylate resin copolymer added with water may be filled fully in the closed chamber 12, capable to transmit temperature and resulting in freezing more quickly than water in the prior art cool mug.

The new low-temperature thermal storage substance used in the present invention is of a block of small particles of solids which expand when soaked with water, possible to be filled in the closed chamber 12 of a cool mug, shortening the time needed for freezing. Further, CaCl as a freeze-resist substance and an antiseptic may be added in the new low-temperature thermal storage substance, making the latter decrease its melting speed as well as elongate the melting time, and not be as very hard as water used in the prior art cool mug after frozen. Experiments made show that the new low-temperature thermal storage substance may be frozen in an hour or so after it is put in a freezer, and defrost in 2–3 hours after it is taken out. So the cool mug in the present invention can keep freezing 2–3 times longer than the prior art one having only one hour serving time.

Figure 3:
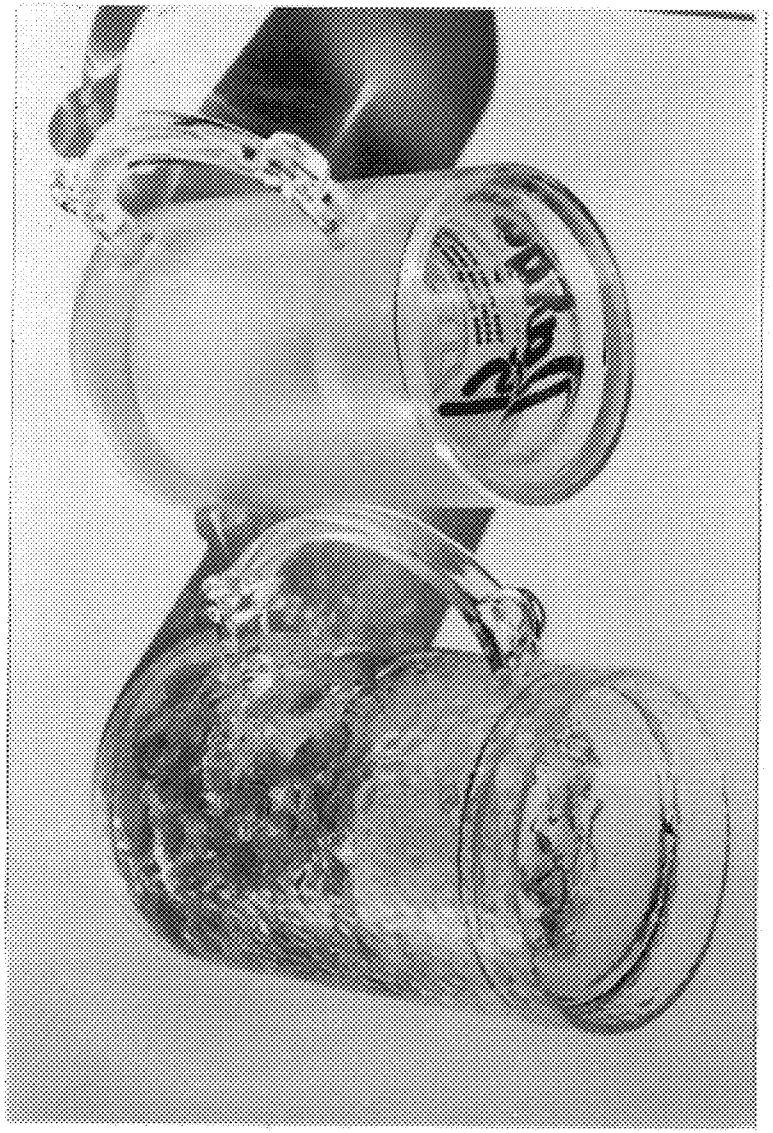

Further, very small pieces of various colors may be added in the new low-temperature thermal storage substance, making the cool mug look colorful in an aesthetically pleasing manner and gives people a pleasant feeling, as shown in FIG. 3, photograph of a real cool mug of the invention.

While the preferred embodiment of the invention has been described above, it will be recognized and understood that various modifications may be made therein and the appended Claims are intended to cover all such modifications which may fall within the spirit and scope of the invention.

What is claimed is:

1. A cooling mug, comprising:

an outer vessel having an open upper end;

an inner vessel suspended within said outer vessel and adapted to receive beverages therein, said inner vessel having an upper rim integrally joined to an inner periphery of said outer vessel proximate said open upper end thereof, an outer surface of said inner vessel and an inner surface of said outer vessel defining a sealed chamber therebetween; and, a semi-solid thermal storage substance completely filling said sealed chamber, said thermal storage substance being produced from a mixture of (a) water, (b) an acrylate resin copolymer to form semi-solid particulates, and (c) a calcium chloride composition added to said acrylate resin copolymer for use as an antiseptic and imparting freeze resistant properties to said thermal storage substance.

* * * * *